United States Patent [19]

Aichinger et al.

[11] 4,412,409

[45] Nov. 1, 1983

[54] METHOD OF CLOSING THE MOUTH OF A CONTAINER AND A SCREW CAP FOR USE THEREIN

[75] Inventors: Dietmar Aichinger, Reinach; Hans-Werner Breuer, Balsthal; Albert Obrist, Kaiseraugst, all of Switzerland

[73] Assignee: Albert Obrist AG, Reinach, Switzerland

[21] Appl. No.: 234,558

[22] Filed: Feb. 13, 1981

[30] Foreign Application Priority Data

Feb. 21, 1980 [DE] Fed. Rep. of Germany ..... 3006481

[51] Int. Cl.[3] ..... B67B 3/22; B67B 3/20; B67B 1/08; B65B 7/28

[52] U.S. Cl. ..... 53/485; 53/489; 53/490

[58] Field of Search ..... 53/489, 490, 487, 488, 53/330, 331.5, 329, 485; 215/329, 344, 9, 252, 341

[56] References Cited

U.S. PATENT DOCUMENTS

| | | | |
|---|---|---|---|
| 3,223,269 | 12/1965 | Williams | 215/329 X |
| 3,435,976 | 4/1969 | Owens | 215/329 |
| 3,441,161 | 4/1969 | Van Baarn | 215/344 X |
| 3,592,349 | 7/1971 | Baugh | 215/329 X |
| 3,707,240 | 12/1972 | Wilson | 215/344 X |
| 3,822,027 | 7/1974 | Cherba | 215/329 X |
| 3,987,921 | 10/1976 | Aichinger | 215/329 X |
| 4,016,996 | 4/1977 | Aichinger et al. | 215/344 |
| 4,098,419 | 7/1978 | Virog, Jr. et al. | 215/329 X |
| 4,210,251 | 7/1980 | Grussen | 53/490 X |
| 4,248,356 | 2/1981 | McCarthy et al. | 53/488 X |

*Primary Examiner*—Horace M. Culver
*Attorney, Agent, or Firm*—William R. Hinds

[57] ABSTRACT

In a method of closing a container having an external screw thread with a cap having an internal thread, the cap is located on the container in a pre-positioning or predetermined angular position corresponding to its final angular position and is then pressed into final closed position by axial force. The cap is located in the pre-positioning position by resilient abutments such as an internal seal, head seal, or projections on the cap which are overcome by the pressing force.

8 Claims, 7 Drawing Figures

METHOD OF CLOSING THE MOUTH OF A CONTAINER AND A SCREW CAP FOR USE THEREIN

FIELD OF THE INVENTION

This invention is concerned with a method of closing the screw-threaded mouth of a container by a screw cap of resilient plastics material having a corresponding thread, with a screw-threaded screw cap for closing a container mouth and with a closure assembly for use in closing a container mouth.

BACKGROUND OF THE INVENTION

There are a large number of known and conventional screw caps and methods of closing container mouths, in particular the mouths of bottles. In such arrangements, the screw cap is generally fitted on to the mouth of the container and then screwed on by means of a screwing-on head, with a predeterminable screwing torque. Screw closures of this kind are described for example in commonly assigned German patent applications Nos. P 25 29 289 and P 28 11 741. Screwing-on heads for closing containers by means of screw caps of that kind are disclosed for example in commonly assigned German patent application No. P 28 52 150.8.

In practice, screw caps of this kind have been extremely successful. In particular, they are superior for some uses to snap-on closures such as are disclosed in H. W. Williams' U.S. Pat. No. 3,223,269. Such snap-on closures have a screw-thread with a pitch which differs from the pitch of the screw-thread on the bottle. This means on the one hand, that, it is not possible to arrive at a surface contact between the threads but only a punctiform contact, and on the other hand, that the cap will probably be tilted on the neck of the container. In addition, with such an arrangement, the depth by which the internal seal penetrates into the neck of the bottle is random so that the internal surface of the neck of the bottle must be formed as a sealing portion over a relatively wide area. This makes it impossible to use so-called head seals which are arranged on the end plate portion of the cap and which co-operate with the rim of the mouth of the container. Seals of this kind, at least as an additional seal, are advantageous in particular for use in relation to $CO_2$-bearing drinks.

PRIOR ART

German Patent Application No. P 25 29 289 (U.S. Pat. No. 4,033,472)

German Patent Application No. P 28 11 741 (U.S. Pat. No. 4,161,258)

German Patent Application No. P 28 52 150.8 (U.S. Pat. No. 4,254,603)

U.S. Pat. No. 3,223,269

FEATURES AND ASPECTS OF THE INVENTION

The present invention has for its object to provide an improved method for applying screw caps and improved screw caps for use in this method. By the invention whereby the screwing-on operation is simplified, technically simpler cap fitting tools which require less servicing can be used, the closure operation can be concluded in a substantially shorter period of time, and it is possible to use head or rim seals.

The present invention provides a method of closing a container mouth provided with a screw-thread, by a screw cap of resilient plastics material with a corresponding thread in which the screw cap is first applied to the container mouth in a predetermined or pre-positioning position corresponding to the final angular position of the screw cap relative to the container mouth when the container is in a closed condition, and the screw cap is then snapped vertically over the threads of the container mouth and pressed into its final position.

Most commercially available containers and screw caps are standardised (for example MC- or MCA-standard, etc.). Accordingly, screw caps and container mouths complying with the same standard (or in specifically adapted form) are generally obtainable. It is then readily possible to determine the angular position in which the screw cap is firmly fitted on the mouth of the container and both the screw cap seal and the screw-threads are in firm engagement. By mounting the screw cap on the container in the predetermined or pre-positioning position, the screw cap is already in a predetermined position, on the mouth of the container, which corresponds to the final position. The container closing operation can then be concluded by a simple vertical pressure without any necessity for the screw cap to be rotated or without a precisely determined torque having to be applied. This is an important advantage of the invention, while the fact that the neck of the container is not subjected to torque loadings is another important consideration.

Positioning of the screw cap can be effected by mechanically sensing the two threads. It is also possible for a marking to be provided on the mouth of the container and on the screw cap, the markings then being sensed for example electro-optically or electromagnetically, and used for positioning purposes. With this arrangement pre-positioning can be effected in screw cap feed means such as is usually employed. However, the invention may be embodied in a particularly advantageous manner if the screw cap is firstly fitted on to the mouth of the container without any particular positioning, and then rotated into the pre-positioning position. The operation of rotating the cap can be effected without applying a high level of torque force. By positioning the cap on the mouth of the container, the relative position of the mouth of the container and the screw cap can also be jointly determined directly in the pre-positioning operation.

The method according to the invention may be performed in a particularly advantageous manner with the screw cap having a resilient abutment means to engage against the mouth of the container and which can be overcome by applying a closure pressure and which is so dimensioned that the screw-thread is partially in engagement in the abutment position, with the abutment position corresponding to the pre-positioning position. It will be seen that arranging the abutment means on the screw cap makes expensive pre-positioning devices unnecessary, and there is also no need for the container mouth to be especially adapted, although that is readily possible. The abutment means provides a simple blocking means which prevents the screw cap from further rotation on the mouth of the container and which holds the screw cap in the pre-positioning position in such a way that the threads of the screw cap can be snapped over the threads on the mouth of the container, by applying a vertical pressure, whereby the closure operation is concluded.

The screw cap according to the invention may be embodied in a particularly advantageous manner by the abutment means being formed by a sealing portion which comes into engagement with the neck of the bottle in the closure operation. In this way, if suitably dimensioned, the sealing portions which are provided in any case in many screw caps can additionally serve as an abutment means so that the screw cap according to the invention can be produced without addition steps or elements. A particularly good centering action and adaptation in respect of the sealing portion to the abutment function can be achieved if the sealing portion is an internal seal which bears against the internal wall of the neck of the container.

The screw cap can be positioned and centered on the bottle in a particularly satisfactory manner by using a screw cap which has a multiple internal thread.

BRIEF DESCRIPTION OF THE DRAWINGS

In the accompanying drawings.

DESCRIPTION OF PREFERRED EMBODIMENTS

Figure 1:
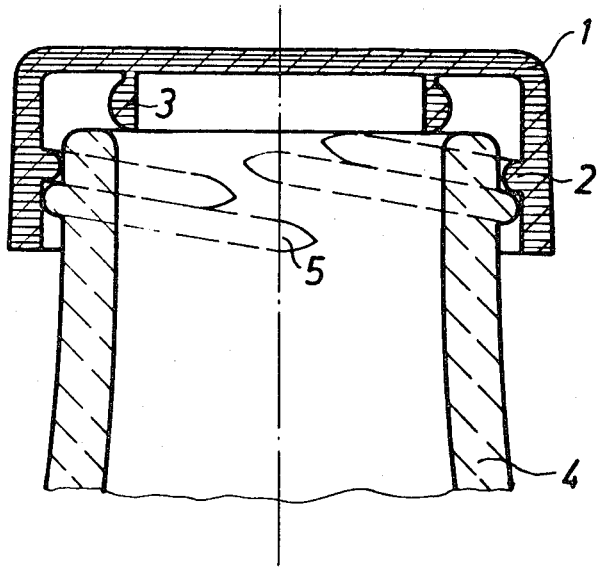
FIG. 1 is a diagrammatic view of a screw cap, having the features of the invention, placed on the neck of a container.
Figure 2:
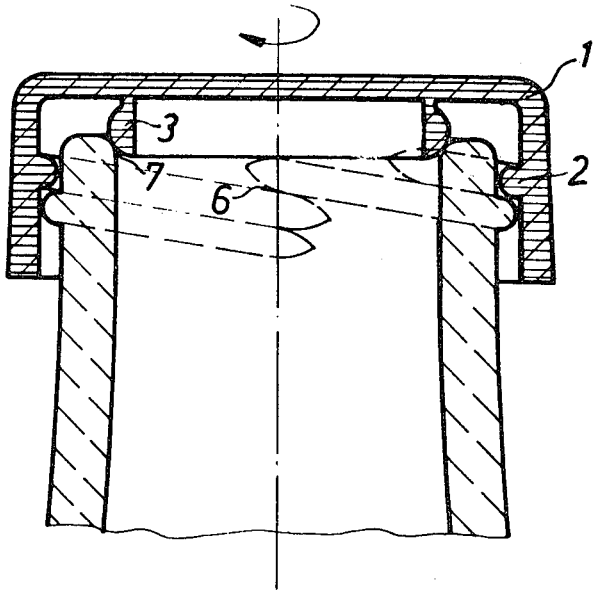
FIG. 2 shows the screw cap of FIG. 1 rotated to a pre-positioning position.
Figure 3:
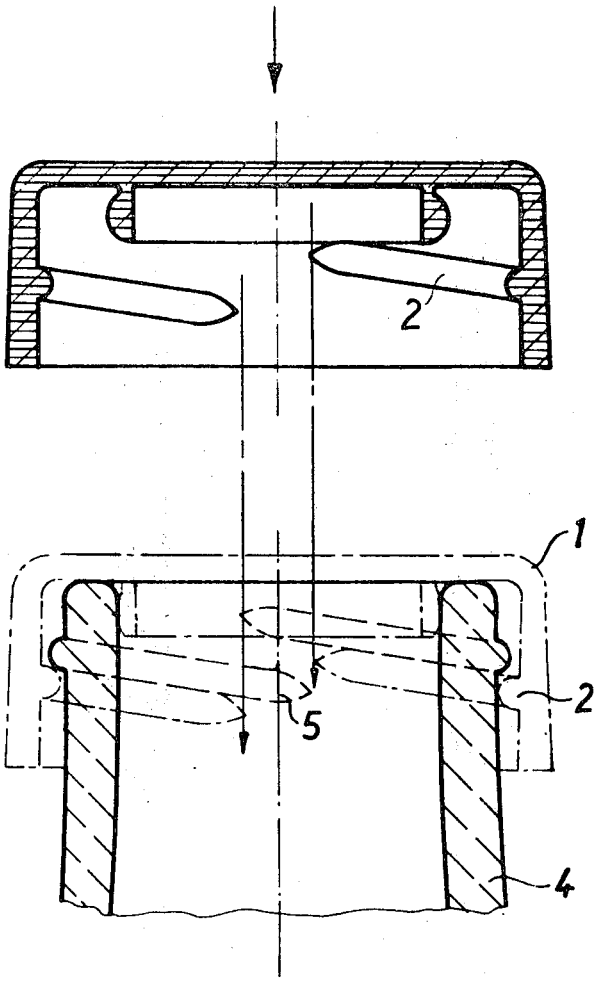
FIG. 3 shows the screw cap of FIGS. 1 and 2 in a condition in which it is not fitted on a bottle, and in dotted lines in the closure condition.

Referring to FIGS. 1 to 3, a screw cap 1 has an internal thread 2 and an annular internal seal 3. When the cap is placed on to the mouth 4 of a container, the pitches of the internal screw-thread 2 are disposed on the pitches of an external screw-thread 5 on the mouth of the container. Slightly rotating the screw cap 1 in the direction of closing thereof causes the internal screw-thread 2 to come partly into engagement with the external screw-thread 5, with contact between the screw-threads at a pressure point 6 at the commencement of the two threads. At the same moment the internal seal 3 bears resiliently against the internal edge 7 of the mouth of the container and it is no longer possible for the screw cap 1 to be screwed further on to the container mouth 4 without additional torque. This means that the screw cap 1 is mounted on the container mouth 4 in a pre-positioning position (FIG. 3) in which the screw cap 1, in angular position relative to the container mouth 4, is already in that final angular position which corresponds to the final position after completely screwing on the screw cap 1. The resilient resistance of the internal seal 3 which bears against the internal edge 7 of the container mouth can now be overcome by applying a vertical pressure, whereupon the internal seal is pressed into the container mouth 4 and at the same time the pitches of the external screw-thread 5 are pressed over the pitches of the internal screw-thread 2. The container mouth 4 is thus closed by the screw cap 1 without the application of any torque force other than the slight torque required for the pre-positioning step. The resiliency of known plastics materials, such as are already used nowadays for screw caps, readily permits the internal screw-thread 2 to snap over the external screw-thread 5.

Figure 4:
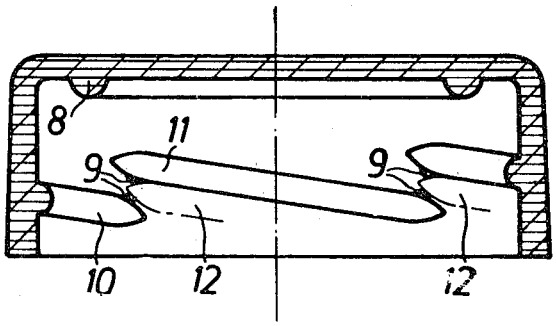
FIG. 4 shows a screw cap with a modified abutment means and with a head or rim seal.

FIG. 4 shows a modified form which does not have an internal seal but only a head seal 8 which engages against the end face of the mouth of the container 4. The abutment means in this embodiment is in the form of two projections 9 between adjacent screw-thread pitches 10 and 11. The projections 9 are formed from the same plastics material as the screw cap 1 and prevent the cooperating screw-threads 12 of the container mouth 4 from freely penetrating between the projections. When a slight torque is applied to the screw cap 1 therefore, the screw cap is located in the pre-positioning postion by the cooperating screw-thread pitches 12 shown in broken line, whereupon the closure operation can be concluded by applying a vertical pressure, similarly to the manner described with reference to FIG. 3. It will be appreciated that it is alternatively also possible for the screw cap 1 shown in FIG. 4 to be screwed on, if a somewhat higher torque is applied to overcome the resistance of the projections 9 so that the cooperating screw-thread pitches 12 on the container mouth 4 can pass between the screw-thread pitches 10 and 11. The resistance afforded by the projections 9 can be readily adjusted by suitable dimensioning and selection of material. For the purpose of closing containers which are subjected to an internal pressure or a vacuum, it is advantageously possible to provide both an internal seal 3 (see FIG. 1) and also the head seal 8, in order to improve the sealing action upon storage. The advantages of the present invention become particularly apparent in that case as pre-positioning of the cap ensures that the screw-thread pitches 10 and 11 bear securely against the cooperating screw-thread pitches 12 in such a way that the function of the head seal 8 is fully maintained.

Figure 5:
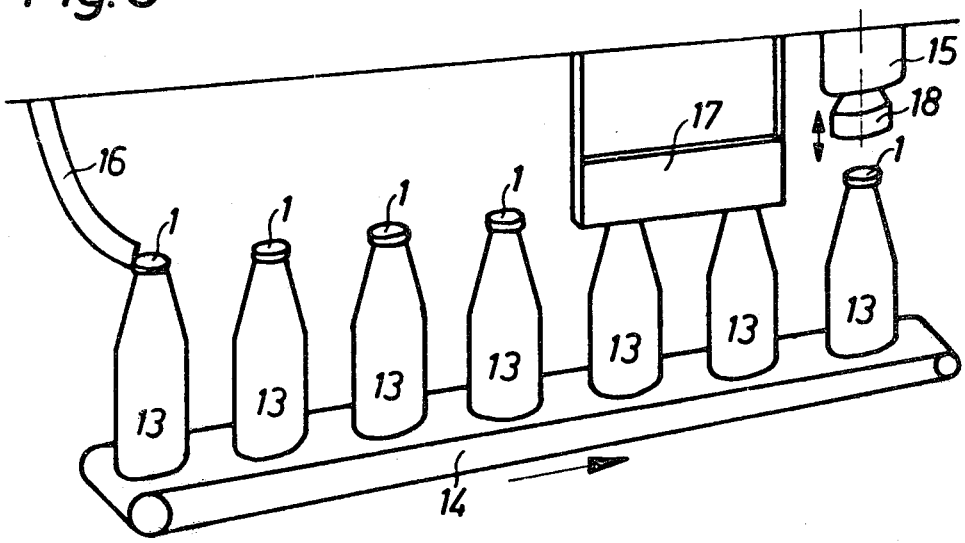
FIG. 5 shows a diagrammatic view of an assembly line for fitting the screw cap as shown in FIGS. 1 to 4.

FIG. 5 is a diagrammatic view showing how the screw caps can be fitted on to a multiplicity of containers 13 in a filling line. The containers 13 are displaced in known manner on a conveyor belt 14 which is advanced in accordance with the operating cycle of a screw cap fitting head 15. In this arrangement, the individual screw caps 1 are firstly placed on the containers 13, from a magazine 16. Upon further forward movement, the mouths of the containers are moved closely past a friction arm 17 so that the arm comes into contact with the screw caps 1. The coefficient of friction of the friction arm 17 is such that, as the containers 13 move forward, the screw caps 1 are rotated slightly in the clockwise direction until the rotary movement is interrupted by the abutment means (internal seal 3 or projections 9) coming into operative engagement. The screw caps 1 are then in the pre-positioning position. Upon further forward movement of the containers 13 on the conveyor belt 14, the screw caps 1 slide along against the friction arm 17 without any further rotary movement. The pre-positioning step is thus effected in a very simple manner and without an expensive arrangement being required to perform that operation.

As soon as the containers 13 pass into a position under the screw cap fitting head 15, the forward movement of the conveyor belt 14 is briefly interrupted and a punch member 18 moves the screw cap 1 by vertical pressure into the definitive screw-on position on the container 13.

Figure 6:
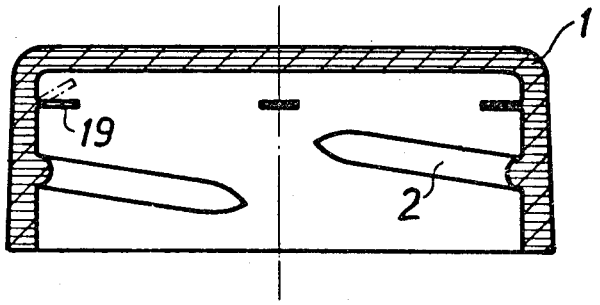
FIG. 6 is a view in partial section of a screw cap with a modified abutment means.
Figure 7:
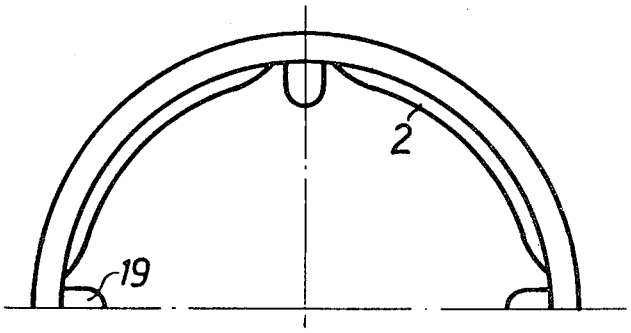
FIG. 7 shows the screw cap shown in FIG. 6, viewed from the open side of the screw cap.

FIGS. 6 and 7 show a screw cap in which the abutment means comprises a multiplicity of tongue portions 19 which project approximately horizontally into the opening in the cap. When the screw cap 1 is screwed on to the mouth 4 of a container with an external screw-thread 5 (see FIG. 1), the tongue portions 19 firstly lie on the upper edge of the mouth 4 of the container and fix the screw cap 1 in the pre-positioning position. By the application of a vertical closure pressure or by overcoming the resilient resistance of the tongue portion 19, the screw cap 1 can then be completely fitted on to the mouth 4 of the container.

It will be seen that the most widely varying configurations in respect of sealing portions or separate projections may be used as abutment means for the pre-positioning step, without thereby departing from the concept of the invention. It is obviously also possible for the abutment means to be provided for example in the form of projections similarly to the projections 9 (see FIG. 4) on the external screw-thread on the mouth 4 of the container, or by corresponding tongue portions or other mechanical abutment means to be disposed on the container mouth. It will be appreciated that this is readily familiar to the man skilled in the art and represents a kinematic interchange of the arrangement of one or more abutment means, which is provided on the screw cap in accordance with the invention. However, providing the abutment means on the screw cap is particularly advantageous because this makes it possible to perform the method according to the invention without modifying the standardised container mouths.

We claim:

1. A method of closing a container mouth having an external screw-thread by a screw cap of resilient plastics material having an internal screw-thread of corresponding pitch, comprising locating the screw cap on the container mouth in a predetermined angular orientation corresponding to the angular orientation of the cap in its final position when the container is closed by screwing on the cap with a certain screw torque to fully engage the threads, and then applying pressure in the axial direction of the container to snap the cap over the threads of the container into its final position as would be occupied if screwed on with said certain torque.

2. A method as claimed in claim 1 comprising a preliminary step of rotating the cap relative to the container to the predetermined angular orientation.

3. A method as defined in claim 1 wherein the threads on the cap and on the container are multiple.

4. A method as claimed in claim 2 wherein the screw-threaded cap includes resilient abutment means which engage the container and are overcome by force applied axially to the cap on the container, said abutment means being of such dimension that the screw threads of the cap and container are in partial engagement in the abutment position corresponding to the predetermined angular orientation.

5. A method as claimed in claim 4 wherein said abutment means comprises a sealing portion contacting the neck of the container in the predetermined angular orientation.

6. A method as claimed in claim 4 wherein said abutment means comprises an internal seal bearing against the internal surface of the container in the final position of the cap.

7. A method of closing a container mouth having an external screw thread by a screw cap of resilient plastic material having an internal screw thread of corresponding pitch, such that the cap is in its final position corresponding to the final position occupied when screwed onto the container mouth with a certain torque to fully engage the threads and seal the container, comprising locating the screw cap on the container mouth in a predetermined relative angular orientation corresponding to that of its final position but without said threads being fully engaged, and then applying force in the axial direction of the container mouth to snap the cap over the threads of the container into said final position as would be occupied if screwed on with said certain torque.

8. A method as claimed in claim 6 wherein the screw cap is located on the container with a random angular orientation, and is rotated to said predetermined relative angular orientation before application of said axial force.

* * * * *